US005452708A

United States Patent [19]

Shimek et al.

[11] Patent Number: 5,452,708

[45] Date of Patent: Sep. 26, 1995

[54] UNIVERSAL HORIZONTAL-VERTICAL (H-V) DIRECT-VENTED GAS HEATING UNIT

[75] Inventors: Ronald J. Shimek, 6665 West Highway 13, Savage, Minn. 55378; Chad T. Vogel, Jordan, Minn.

[73] Assignee: Shimek; Ronald J., Savage, Minn.

[21] Appl. No.: 157,819

[22] Filed: Nov. 24, 1993

Related U.S. Application Data

[63] Continuation of Ser. No. 63,887, May 18, 1993, abandoned.

[51] Int. Cl.[6] ..... F23C 3/00

[52] U.S. Cl. ..... 126/512; 126/85 B; 126/92 R; 431/125

[58] Field of Search ..... 126/85 B, 512, 126/531, 521, 80, 83, 527, 529, 535, 518, 289, 307 R, 312, 536; 237/50–55; 431/125

[56] References Cited

U.S. PATENT DOCUMENTS

| | | | |
|---|---|---|---|
| 2,131,763 | 10/1938 | Sroat | 126/531 |
| 3,096,754 | 7/1963 | Howrey | 126/512 |
| 4,015,581 | 4/1977 | Martenson | 126/531 |
| 4,262,608 | 4/1981 | Jackson | 126/85 B |
| 4,285,327 | 8/1981 | Buckner | 126/500 |
| 4,519,376 | 5/1985 | Schoeff et al. | 126/531 |
| 4,653,467 | 3/1987 | Farrell | 126/531 |
| 4,793,322 | 12/1988 | Shimek et al. | 126/512 |
| 4,909,227 | 3/1990 | Rieger | 126/85 B |
| 5,014,684 | 5/1991 | Meeker | 126/531 |
| 5,016,609 | 5/1991 | Shimek et al. | 126/85 B |
| 5,076,254 | 12/1991 | Shimek et al. | 126/512 |
| 5,218,953 | 6/1993 | Shimek et al. | 126/512 |
| 5,267,552 | 12/1993 | Squires et al. | 126/512 |
| 5,320,086 | 6/1994 | Beal et al. | 126/512 |

*Primary Examiner*—James C. Yeung
*Attorney, Agent, or Firm*—John B. Sowell

[57] ABSTRACT

A novel horizontal-vertical (H-V) direct vented gas heating unit comprises a box-shaped heating unit having seven walls which surround a combustion chamber. One of the seven walls comprises a diagonal wall connected between the back vertical wall and the top wall. An exhaust stack extends through the diagonal wall and is surrounded at its exit by a coaxial fresh air inlet adapter which connects to a fresh air passageway which extends down the back wall. An inner heat exchanger comprise passageways which extend along six of the seven walls outside the combustion chamber. The fresh air passageway on the back wall extends through the heat exchanger passageway in the back wall and enters a plenum having two exits, one of which is positioned opposite the upper level and the other opposite the lower level of a dual level burner.

14 Claims, 4 Drawing Sheets

UNIVERSAL HORIZONTAL-VERTICAL (H-V) DIRECT-VENTED GAS HEATING UNIT

This is a continuation of applications Ser. No. 08/063, 887, filed May 18, 1993, abandoned.

BACKGROUND OF THE INVENTION

1. Field of the Invention

The present invention relates to high efficiency, low cost universal direct-vented gas heating units. More particularly, the present invention relates to a multi-purpose horizontal or vertical direct vented gas heating unit having sealed combustion chambers and very high thermal efficiency which conforms to the newly mandated Annual Fuel Utilization Efficiency (AFUE) standards.

2. Description of the Prior Art

Heretofore direct vented zero clearance gas fireplace units were known and have been classified in International Class 1/14. Our U.S. Pat. No. 4,793,322 shows and describes a prefabricated zero clearance direct-vented gas fireplace unit capable of high thermal efficiency and low exhaust stack temperatures. An optional replaceable catalytic conversion unit is installed in the exhaust gas path when it was necessary to reduce carbon monoxide (CO) levels to meet local pollution standards. This prefabricated fireplace unit was manufactured as a horizontal rear vent model and as a vertical top vent model. The two models employ the same mode of operation but require distinctively different parts or elements to complete manufacture in one of the two implementation models.

Our U.S. Pat. No. 4,852,548 shows and describes a free standing universal type fireplace which employs a frame or base structure which is prefabricated. The universal frame is employed on a universal production line to produce a plurality of different type fireplaces by attaching different wall structures to the universal frame. This patent recognizes that the cost of production and inventory is reduced when a production line is tooled for mass production and optimum efficiency.

The present invention comprises an improvement in both of the above mentioned patents in that the present invention fireplace unit is both a top vent (vertical) and a back vent (horizontal) zero clearance fireplace. The novel universal heating unit may also be used as a free standing stove or as an insert for an existing fireplace. Further, the cost of making the present invention universal high thermal efficiency zero clearance fireplace unit has been reduced by requiring a lesser number of structural parts that are designed for low cost manufacturing and low cost automated assembly.

The present invention fireplace provides a structure which can be made from fewer low cost parts and is adapted for precise assembly on a low cost dedicated high efficiency production line.

SUMMARY OF THE INVENTION

A principal object of the present invention is to provide a standard or universal direct vented zero clearance gas fireplace for horizontal or vertical exhaust pipe connections.

Another principal object of the present invention is to provide a universal or standard zero clearance gas fireplace unit usable for coaxial type top exhaust vent applications.

Another principal object of the present invention is to provide a universal standard gas heating unit having a novel fresh air plenum in the bottom of the combustion chamber adapted to be connected to an outside source of fresh air for combustion supplied from any one of a plurality of sources.

Another principal object of the present invention is to provide a single universal standard gas heating unit which replaces up to four different prior art heating units.

Another principal object of the present invention is to provide a universal standard gas fireplace having fewer and simpler parts than prior art gas fireplaces yet is capable of meeting the stringent new AFUE, CO, and efficiency standards.

Another principal object of the present invention is to provide a novel gas fireplace unit having a high AFUE unit so as to permit use of a thermostat with a standing pilot light.

It is another object of the present invention to provide means for adjusting and maintaining a minimum temperature in the combustion chamber under variable draft conditions.

It is another object of the present invention to provide means for maintaining and adjusting a desirable range of temperatures in the exhaust stack and on the viewing glass under variable draft conditions.

According to these and other objects of the present invention, there is provided a high efficiency low cost universal zero clearance direct-vented gas heating unit having an outer rear panel and an outer top panel connected by a diagonal panel through which is provided an exhaust stack directed at an angle substantially orthogonal to said diagonal panel. The exhaust stack passes through a heat exchanger plenum and a fresh air plenum and connects into the combustion chamber and is directed at an angle which permits a forty-five degree elbow to be connected to direct the exhaust gasses either in a horizontal or vertical direction.

DESCRIPTION OF THE PREFERRED EMBODIMENT

The Department of Energy (DOE) has mandated AFUE standards for home heating type appliances. Most decorative appliance units employed as direct vented zero clearance fireplace units do not meet the AFUE standards and cannot be classified as a source of primary heat for a home. California and New York prohibit the use of a continuous standing pilot light requiring electronic ignition systems to be installed for use in those states. Further, a new energy tax is being passed through Congress that will penalize medium to low efficiency heating units. The present invention decorative heating units have been tested and are capable of meeting ANSI certification and AFUE standards, thus, may be used as primary heating units allowing use with thermostats in all types of homes. Further, the above ANSI standards prohibit use of thermostat controls on decorative gas appliance units unless they do meet the ANSI heater standards, including thermal efficiency requirements and AFUE standards, which would also prevent the use of the decorative unit as a primary heating source for a home.

Figure 1:
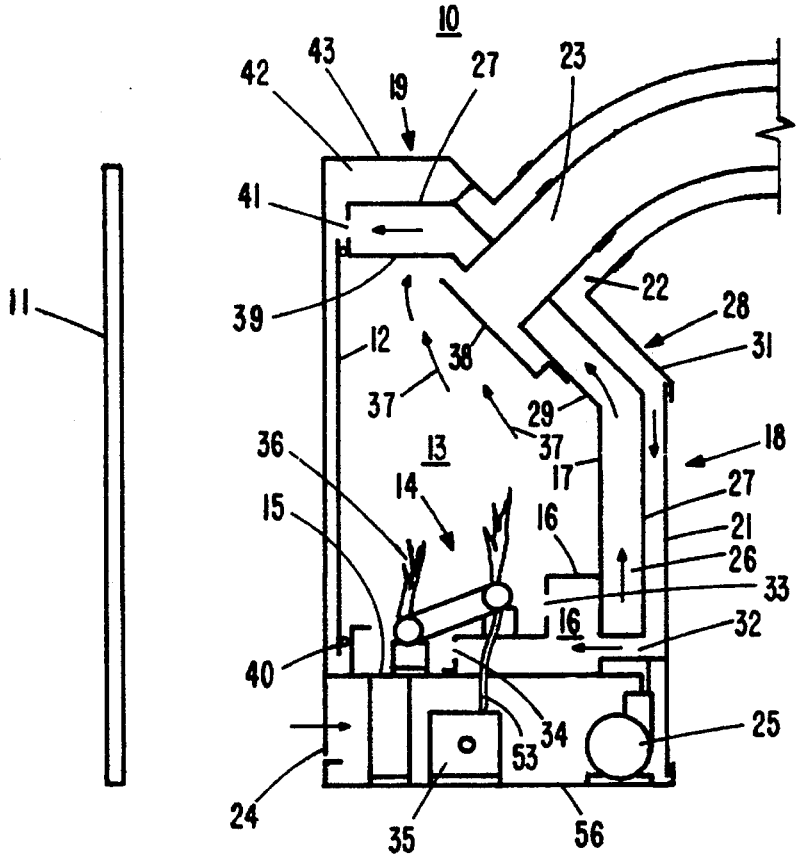
FIG. 1 is a side elevation in cross-section taken through the present invention fireplace unit showing the front shroud removed.

Refer now to FIG. 1 showing in side elevation and cross-section the present invention heating unit 10. The heating unit 10 comprises a decorative front shroud 11 which mounts on the front face of the unit 10 juxtaposed a sealed glass member 12. The combustion chamber 13 contains a two-level burner unit 14 which is supported on the floor 15 of the combustion chamber and the fresh air plenum 16 which mounts against the rear wall 17 of the combustion chamber and the floor of the combustion chamber 13. The combustion chamber 13 is surrounded by the front glass wall 12, rear wall 18, the bottom wall 15, a top wall 19. The rear wall 18 comprises an outer channel shaped, panel 21 and is connected to a panel 17 or 27 in wall 18 forming a passageway source of fresh air 22 which surrounds the exhaust stack 23, thus, preheating the combustion air as it enters the area surrounding the exhaust stack 23.

A high efficiency heat exchanger is provided surrounding the combustion chamber 13. Room air enters through a grill in the shroud 11 as shown at point 24 and proceeds below the combustion chamber floor 15 to the intake of the blower 25. Air from the blower 25 is exhausted in an upward direction in the vertical portion of the heat exchanger 26 which comprises the inner panel 17 and a middle panel 27 of the wall 18. A diagonal wall 28 comprises an inner diagonal panel 29 and an outer diagonal panel 31 which may be attached to the middle panel 27 to form a passageway from the fresh air source at point 22 down the back of the heat exchanger 26 to the passageways 32 which extend through the heat exchanger 26. The fresh combustion air enters the space of plenum 16 previously described. The plenum 16 is provided with an upper slot or grill 33 which provides combustion air to the upper burner unit. Further, a lower slot or grill 34 in the plenum 16 provides fresh combustion air for the lower pipe of the burner 14. The lower burner pipe is connected to the upper burner pipe in a U configuration and is capable of supplying a long decorative flame 36 at both portions of the burner unit. The exhaust gasses shown at 37 are directed around the deflector plate 38 and enter into the exhaust stack 23 after completely heating the upper panel 39 and the diagonal panel 29 of the combustion chamber.

In the preferred embodiment of the present invention, the heat exchanger 26 exhausts its heated gas through grill 41. As will be explained hereinafter, a convection heat exchanger is provided along the back wall of the heating unit 10 and exhausts its heated gasses through the convection heat exchanger 42 formed by the outer panel 27 of the heat exchanger 26 and the top of the heating unit 43.

Figure 2:
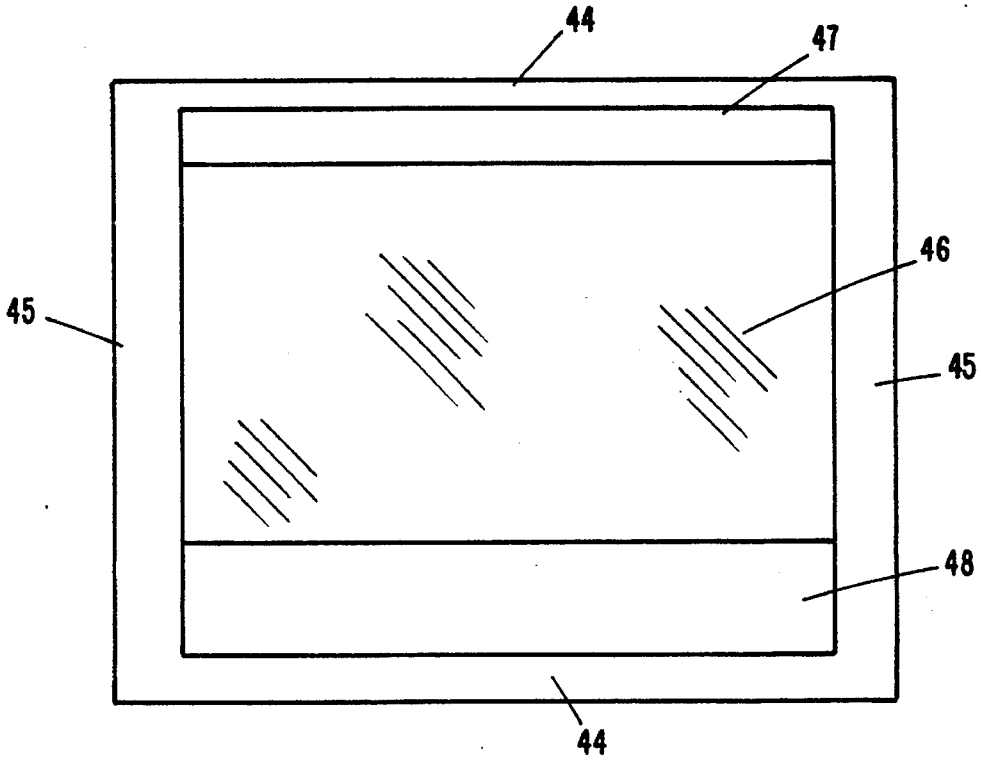
FIG. 2 is a front elevation showing the front shroud of the fireplace unit of FIG. 1.

Refer now to FIG. 2 showing a front view of the decorative shroud shown in FIG. 1. The shroud 11 comprises two horizontal frame members 44 connected to two vertical frame members 45 which support a protective mesh screen 46 therebetween so as to leave openings 47 and 48 opposite the grills 41 and 24 respectively.

Figure 3:
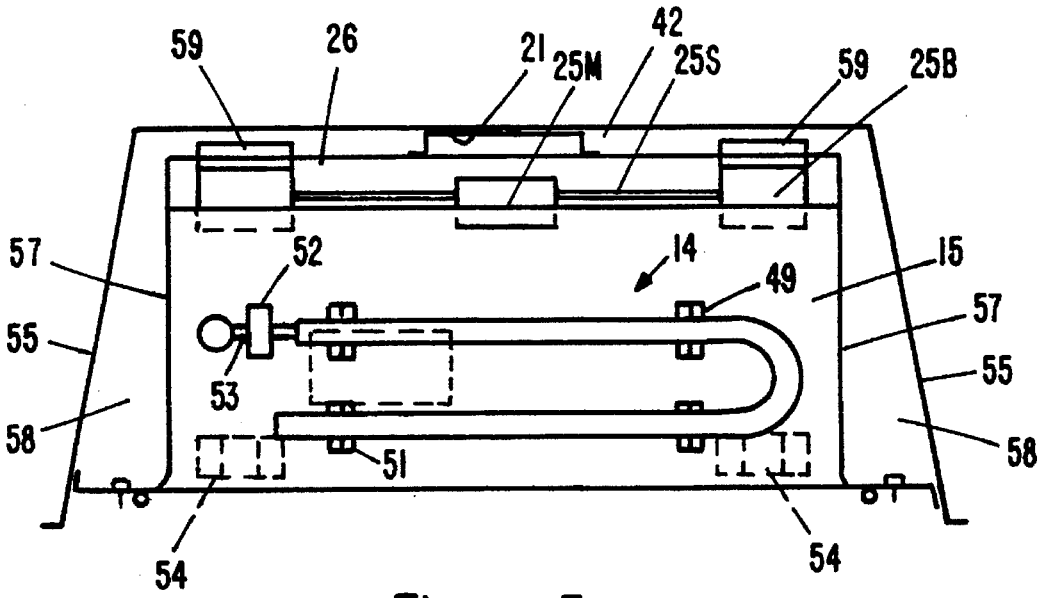
FIG. 3 is a plan view in cross-section showing a preferred two stage burner and a preferred heat exchanger blower.

Refer now to FIG. 3 showing a plan view in cross-section of the heating unit 10 shown in FIGS. 1 and 2. The bottom wall of the combustion chamber 15 is shown supporting the dual level burner unit 14 on upper and lower supports 49 and 51, respectively. The burner unit 14 is shown having primary air mixing valve 52 connected in the gas supply line 53. The floor of the combustion chamber 15 is supported on four stand-off supports 54 only two of which are shown. The blower motor 25 preferably comprises a motor 25M which is connected by a pair of shafts 25S to a pair of blowers 25B. The blowers are placed so that room air entering through the grill 24 is drawn into the side of the blowers 25B and expelled vertically upward into the heat exchanger 26. In the preferred embodiment of the present invention an outer shell or shroud 55 surrounds the heating unit 10. The side walls of the outer shell 55 extend to the bottom panel 56 which forms a heat exchange passageway with the combustion chamber floor 15. This passageway connects to the passageway formed by panels 57 and 55. The space 58 therebetween forms a dead air space through which some air will flow to the top convection heat exchanger 42. When the blower exhaust outlet 59 is arranged to exhaust air into the heat exchanger 26 and the outer heat exchanger 42, it will aspirate some air from the passageways 58 and further increase the efficiency of the heat exchanger. It will be understood that when the outer shroud used for high heat efficiency is removed that the walls 57 will extend vertically downward to the bottom panel 56 and panel 21 is as described in FIG. 1. It will be explained in greater detail hereinafter that the shroud 55 is not a preferred use for a stove or insert.

Figure 4:
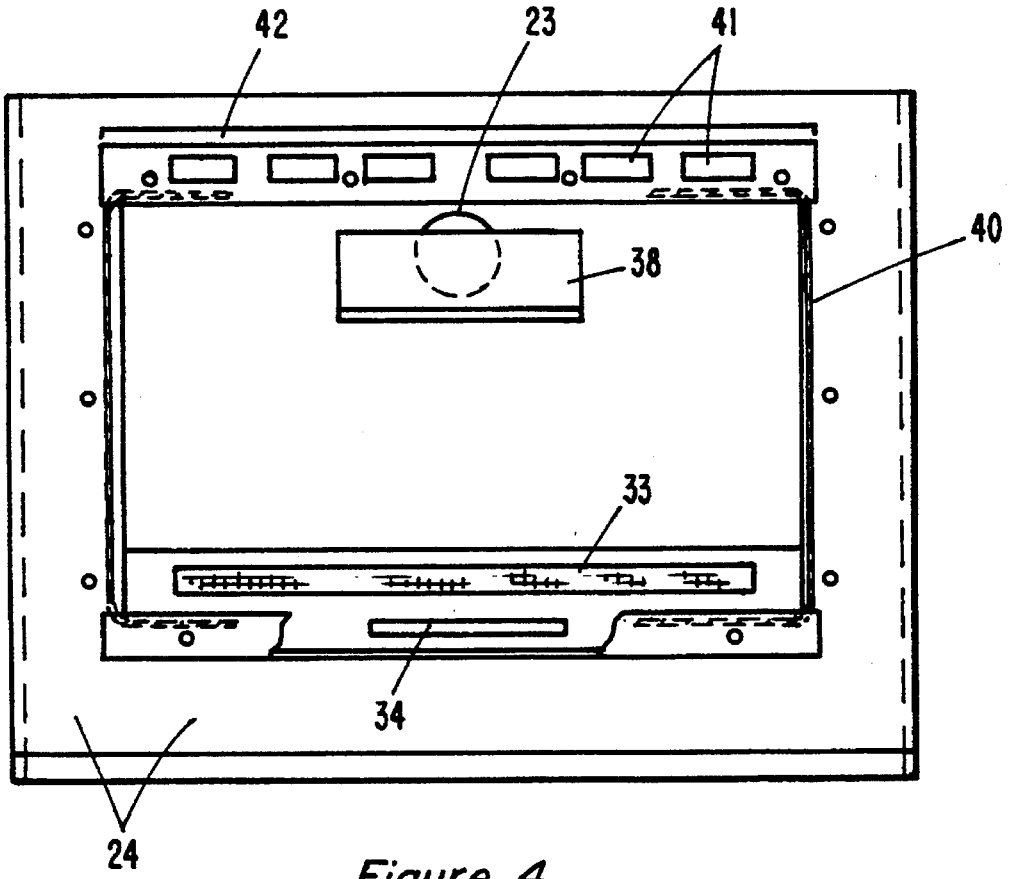
FIG. 4 is a front elevation in partial section showing the combustion air supply grills in the combustion chamber and the heat exchanger exhaust grills.

Refer now to FIG. 4 showing a front elevation in partial section of the heating unit 10 and the combustion air supply grills 33 and 34. The exhaust grills 41 and 42 for the high efficiency heat exchanger 26 and the convection heat exchanger 42 are connected behind the combustion chamber to the home air inlet grill 24 as explained hereinbefore. In the preferred embodiment of the present invention, the room air entering the grill 24,48 can be forced to pass through both heat exchangers using the same blower 25B as used for the heat exchanger 26.

Figure 5:
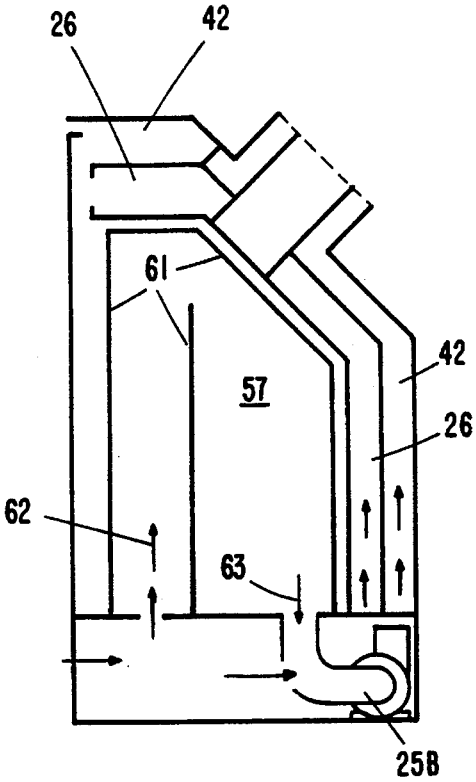
FIG. 5 is a side elevation of a modified fireplace unit showing a side mounted outer heat exchanger coupled to the master heat exchanger blower.

Refer now to FIG. 5 showing a side elevation of a modified heating unit having a side mounted outer heat exchanger 61 which comprises boxes which may be mounted onto the side walls 57 of the combustion chamber 15. The heat exchanger 61 may comprise an open box or a plurality of L or Z shaped structural members 61 which cause the inlet air from the room to enter at point 62 and exit at point 63, thus sweeping the side wall 57 of the combustion chamber 13 before entering the inlet of the blower 25B. The preheated air is mixed with room air which also enters the inlet of blower 25B and is exhausted into the passageways which form the previously described heat exchangers 26 and 42.

Figure 6:
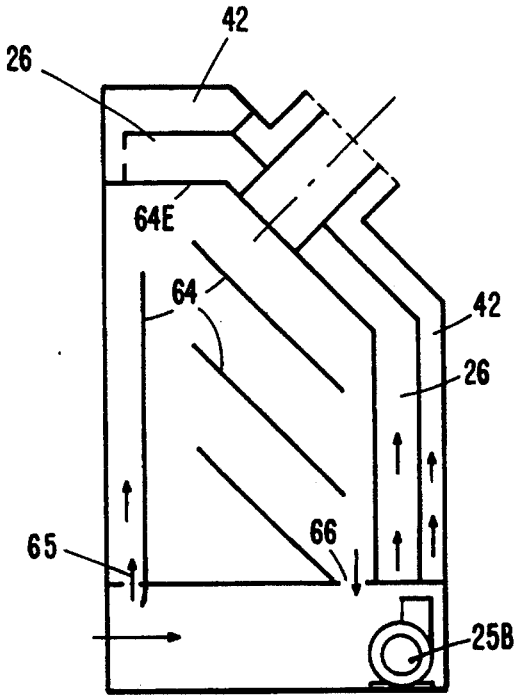
FIG. 6 is a side elevation of another modified fireplace unit showing a different side mounted outer heat exchanger of the type shown in FIG. 5.

Refer now to FIG. 6 showing a side elevation of another modified heating unit showing a different side mounted outer heat exchanger 64 which preferably comprises L or Z shaped member 64 which control the passage of the air 65 up along the edge of side wall 57 and is retained by an upper extension 64E to pass along the passageways formed by the diagonal member 64 into the exhaust passage 66 before entering the inlet of the blower 25B. In this embodiment, the inlet of the blower 25B forms a low pressure area which causes the room air to be diverted through the modified heat exchanger 64. The air exhausted from the blower 25 enters into the two heat exchangers 26 and 42 as explained hereinbefore.

Figure 7:
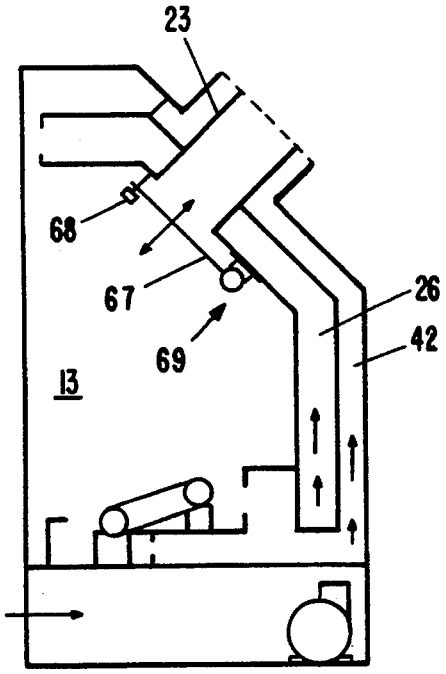
FIG. 7 is a side elevation in cross-section of the fireplace unit shown in FIG. 1 having an accessible and adjustable damper over the exhaust stacks.

Refer now to FIG. 7 showing a side elevation in cross-section of a heating unit of the type shown in FIG. 1 having an adjustable damper 67 which has a stand-off unit 68 which limits the amount the adjustable damper 67 can open. A bimetallic element shown generally at 69 comprises a bimetallic spring and housing which causes the adjustable damper 67 to close whenever the temperature in the combustion chamber falls below a predetermined set level. The reason for providing an adjustable diverter in the exhaust gas path is to assure that the efficiency of the unit remains high when a long vertical stack causes a high draft condition which could aspirate additional fresh combustion air through the unit and would decrease its efficiency. If it was possible to know the exact horizontal and vertical run of the exhaust stack and coaxial fresh air intake, it would be possible to calculate the exact draft conditions, it would be possible to calculate the exact desirable position of the adjustable damper 67 and it could be set permanently at the factory. However, such conditions never exist in the field and even though it would be possible to provide the field engineers with a table to calculate the position of the adjustable damper 67, it has been found that an automatic adjusting damper is more efficient than depending on field engineers.

Figure 8:
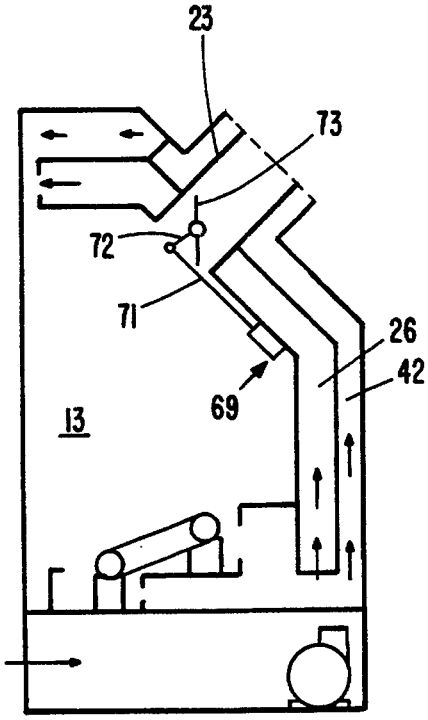
FIG. 8 is a side elevation in cross-section of the fireplace unit shown in FIG. 1 having an accessible and adjustable damper in the exhaust stack.

Refer now to FIG. 8 showing a side elevation in cross-section of a heating unit having an adjustable damper in the exhaust stack. In this embodiment a housing and bimetallic spring 69 shown connected by two levers 71 and 72 to a pivotable damper 73 placed in the exhaust stack 23. In the preferred embodiment of the present invention, the damper 73 is so constructed that it can never completely close the exhaust stack 23.

Having explained the preferred embodiment automatic adjusting damper arrangements to generate the highest possible efficiency it will be appreciated that dampers 67 and 72 of FIGS. 7 and 8 are placed inside of the combustion chamber 13 where rapid manual access is available.

Figure 9:
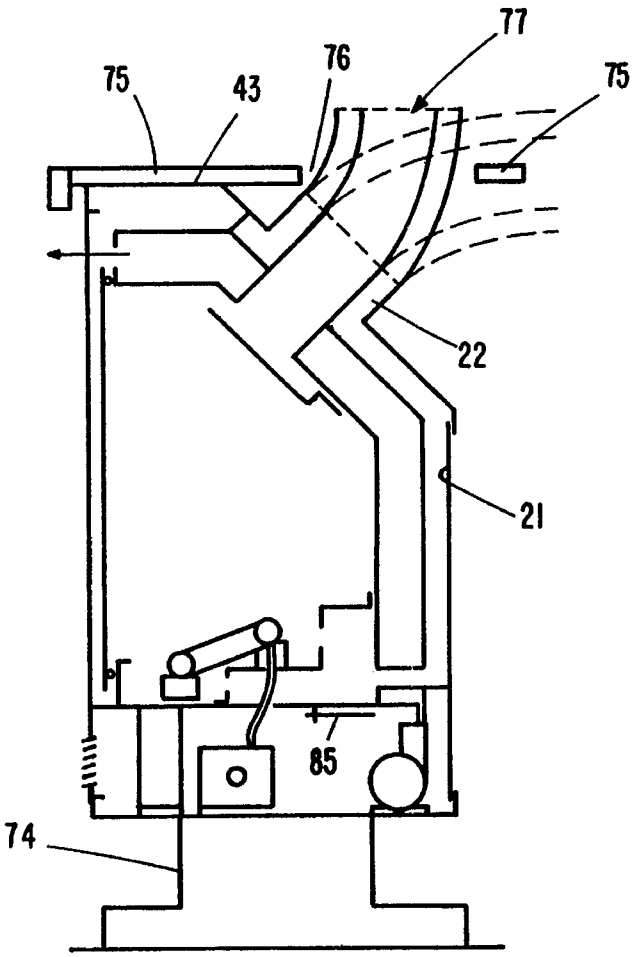
FIG. 9 is a schematic elevation in crosssection of the fireplace unit of FIG. 1 mounted on a pedestal to provide a stand-alone stove heating unit.

Refer now to FIG. 9 showing a schematic elevation and cross-section of a fireplace unit of the type shown in FIG. 1 which is mounted on a pedestal 74 to provide a stand-alone stove heating unit. In this embodiment, the stand-alone stove heating unit does not include an outer shell 55, but does include the fresh air passageway 22 which connects to the channel shaped member 21 attached to the middle panel 27 as shown in FIG. 3. When the heating unit is used for a decorative stove, a decorative top unit 75 is attached to the top panel 43. The panel 43 is provided with an aperture 76 to permit the coaxial elbow 77 to extend therethrough. It will be understood that the coaxial elbow may be extended either horizontally or vertically depending on the installation conditions, otherwise, the unit is substantially identical to that shown and described in FIGS. 1 and 3.

Figure 10:
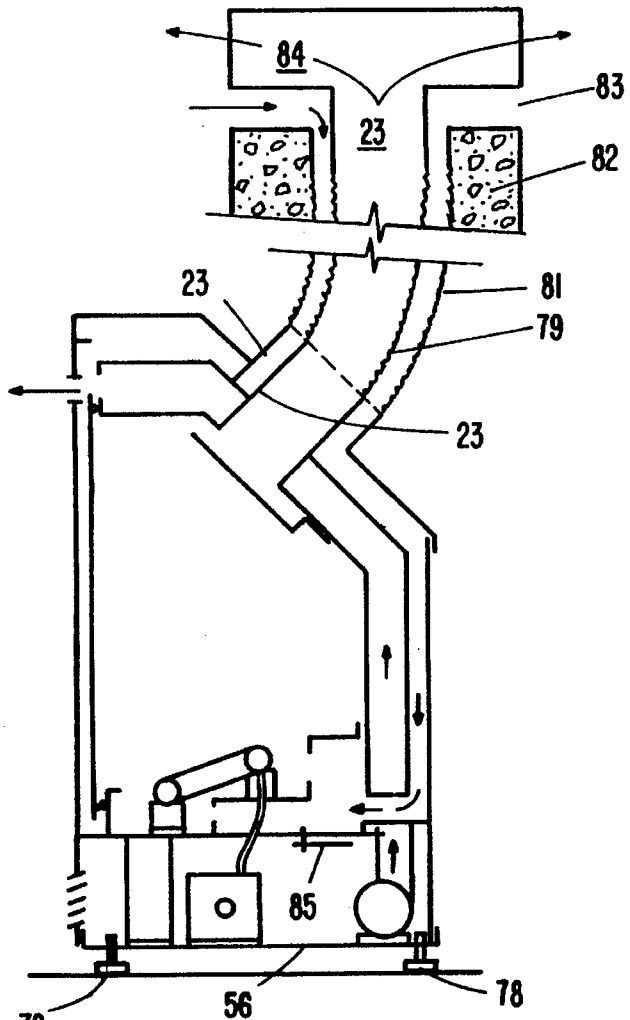
FIG. 10 is a schematic elevation in cross-section of the heating unit of FIGS. 1 and 3 with the outer fireplace shell removed to provide a direct vented insert for masonry or equivalent fireplaces.

Refer now to FIG. 10 showing a schematic drawing in elevation and cross-section of a heating unit of the type shown in FIGS. 1 and 3 with the outer fireplace shell 55 removed to provide a direct-vent insert for masonry or equivalent fireplaces. The heating unit is shown having adjustable legs 78 coupled through the bottom panel 56. Further, the exhaust stack 23 is preferably coupled to a accordion flexible liner 79 and has a coaxial accordion flexible liner 81 connected to the fresh air intake 23. The liners 79 and 81 extend up through the masonry chimney 82 and terminate in a closure plate 83 which seals the outer liner 81 against the top of the chimney and further includes a conventional chimney cap of the type which has either perforations or openings to allow the exhaust gasses to escape and prevent rain from coming down the exhaust stack 23.

Having explained a preferred embodiment of the present invention and two modifications showing how the heating unit can be used as a stove or an insert, it will be understood that at least four types of heating units can be made on one dedicated production line for use in different environments. Even though the stove and fireplace insert of FIGS. 9 and 10 have been shown having a coaxial stack, and FIG. 10 extends through an existing masonry chimney, it is also possible to connect the source of fresh air directly through a vent extending horizontally through the masonry chimney and through panel 35. In a preferred embodiment of the present invention, it is possible to extend the two coaxial stacks through a 6" horizontal hole in an existing masonry chimney and cap the masonry chimney. Further, it is possible to drill two 4" holes through an existing masonry chimney to connect one of the 4" pipes to the fresh air inlet at panel 85 and the other 4" pipe to the exhaust stack.

What is claimed is:

1. A universal horizontal-vertical direct-vented gas heating fireplace for installation in an interior space to be heated, comprising:

a box-shaped heating unit having seven walls comprising a top wall, a bottom wall, four vertical side walls and a diagonal back wall, said diagonal back wall connecting between said top wall and a back vertical wall of one of said four vertical walls, said diagonal back wall having a first heat exchanger passageway and an outer fresh combustion air passageway connected therein, a combustion chamber connected in said box-shaped heating unit inside said seven walls, a second heat exchanger comprising baffle means connected to the two sidewalls of the combustion chamber adjacent to the rear wall, said baffle means includes an inlet connected to said first heat exchanger passageway, an exhaust stack extending through said diagonal back wall and through said first heat exchanger passageway and connected into said combustion chamber at an angle perpendicular to said diagonal back wall, a fresh combustion air inlet adapter mounted on said diagonal back wall surrounding said exhaust stack and connected to said outer fresh combustion air passageway in said diagonal back wall, inner heat exchanger passageways connected to said combustion chamber in said bottom wall, said top wall and a back vertical wall and being interconnected with said first heat exchanger passageway in said diagonal back wall, a fresh air passageway in said back vertical wall connected to said outer fresh combustion air passageway in said diagonal wall and connected into the back of said combustion chamber, and said exhaust stack and said combustion air inlet adapter being directed both backward and upward at an inclining angle so that an elbow connection of approximately forty-five degrees will connect the fireplace to either a horizontal or a vertical exhaust stack extension.

2. A universal horizontal-vertical heating unit as set forth in claim 1 wherein said baffle means includes an outlet, and blower means in said heat exchanger passageway in said bottom wall having an inlet coupled to the outlet of said baffle means and to said heat exchanger passageway.

3. A universal horizontal-vertical heating unit as set forth in claim 2 wherein said blower means further comprises exhaust means for directing preheated air from said baffle means and from said heat exchanger passageway in said bottom wall into said rear vertical wall having an inner heat exchanger passageway and a outer second heat exchanger passageway.

4. A universal horizontal-vertical heating unit as set forth in claim 3 wherein said second heat exchanger comprises an outer passageway in said top wall connected to said outer second heat exchanger passageway.

5. A universal horizontal-vertical direct-vented gas heating fireplace, comprising:

a box-shaped outer fireplace unit comprising a plurality of connected sheet metal panels, a combustion chamber inside of and spaced apart from said outer fireplace unit comprising a plurality of connected sheet metal panels, said sheet metal panels of said fireplace unit and said combustion chamber forming a plurality of interconnected walls therebetween, a room air heat exchanger comprising interconnected bottom, back vertical, back diagonal and top walls, a second room air heat exchanger comprising a sheet metal panel in said back vertical and back diagonal walls and connected to back vertical and back diagonal panels of said combustion chamber, a fresh air passageway comprising a formed sheet metal panel connected to back vertical and back diagonal panels in said back vertical and back diagonal walls, a combustion air plenum inside said combustion chamber connected to said fresh air passageway, a fresh combustion air opening formed in back diagonal panel of said fireplace unit and opening into said fresh air passageway, an exhaust stack extending through said back diagonal wall, said fresh air passageway and said second heat exchanger and having an opening connecting into said combustion chamber, and an adjustable exhaust draft baffle in said combustion chamber spaced apart from and covering said exhaust stack opening for restricting the flow of hot exhaust gases and for increasing the thermal efficiency of said gas heating fireplace.

6. A universal horizontal-vertical heating unit as set forth in claim 5 which further includes two level burner means having a lower and an upper level mounted on said combustion chamber floor and said fresh air plenum, respectively, and a lower slot combustion air exit and an upper slot combustion air exit in said fresh air plenum opposite the lower and upper levels of said two level burner means.

7. A universal horizontal-vertical heating unit as set forth in claim 5 which further includes means for restricting the flow of exhaust gases from said burner means to variably compensate for variable draft conditions in said exhaust stack imposed by different exhaust stack extensions.

8. A universal horizontal-vertical heating unit as set forth in claim 5, which further includes means in said combustion chamber for automatically adjusting the draft of exhaust gases in said exhaust stack.

9. A universal horizontal-vertical heating unit as set forth in claim 8 wherein said means for adjusting the draft of exhaust gases in said exhaust stack comprises a movable diverter mounted in said combustion chamber over said exhaust stack.

10. A universal horizontal-vertical heating unit as set forth in claim 8 wherein said means for adjusting the draft of exhaust gases in said exhaust stack comprises a movable damper mounted in said exhaust stack.

11. A universal horizontal-vertical heating unit as set forth in claim 8 wherein said means for adjusting the draft of exhaust gases in said exhaust stack comprises means for sensing the temperature in said combustion chamber coupled to said means for automatically decreasing the draft of said exhaust gases from said combustion chamber when a predetermined lower threshold temperature occurs.

12. A universal horizontal-vertical heating unit as set forth in claim 5 which further includes a decorative top unit mounted on said heating unit and a pedestal unit for supporting said heating unit to provide a direct-vented stove.

13. A universal horizontal-vertical direct vented gas heating fireplace, comprising:

a box-shaped outer fireplace unit comprising a plurality of connect sheet metal panels, a combustion chamber inside and spaced apart from said outer fireplace unit comprising a plurality of connected sheet metal panels, said sheet metal panels of said fireplace unit and said combustion chamber forming a plurality of interconnected walls between said fireplace unit and said combustion chamber, room air heat exchanger means comprising interconnected bottom, back vertical, back diagonal and top walls, a fresh air passageway comprising a formed sheet metal panel connected to panels in said back vertical and back diagonal walls outside of said combustion chamber, a burner system in said combustion chamber, a combustion air plenum in said combustion chamber extending under said burner system, a fresh combustion air opening extending through a back diagonal panel of said fireplace unit and connecting into said fresh air passageway, an exhaust stack extending through said back diagonal wall of said fireplace and through said fresh air passageway forming an opening connecting into said combustion chamber, and an exhaust draft baffle in said combustion chamber spaced apart from and covering said exhaust stack opening, said exhaust draft baffle having means for adjustably restricting the flow of hot exhaust gases from combustion chamber to compensate for different draft conditions and for increasing the thermal efficiency of said gas heating fireplace.

14. A universal horizontal-vertical heating unit as set forth in claim 13 wherein said fresh air passageway comprises a channel shaped member connected to the back of said combustion chamber in said room air heat exchanger means.

* * * * *